US007759592B2

(12) United States Patent
Mackay

(10) Patent No.: US 7,759,592 B2
(45) Date of Patent: Jul. 20, 2010

(54) SEAL FOR ELECTRICAL SWITCH PAD

(75) Inventor: Allyn R. Mackay, Grosse Pointe, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 234 days.

(21) Appl. No.: 12/026,282

(22) Filed: Feb. 5, 2008

(65) Prior Publication Data

US 2009/0194400 A1 Aug. 6, 2009

(51) Int. Cl.
*H01H 13/06* (2006.01)

(52) U.S. Cl. ..... 200/302.2; 200/302.1

(58) Field of Classification Search ..... 200/293, 200/295, 296, 302.2–302.3
See application file for complete search history.

(56) References Cited

U.S. PATENT DOCUMENTS

| | | | | |
|---|---|---|---|---|
| 4,298,778 | A * | 11/1981 | Beresford-Jones | 200/302.2 |
| 6,794,592 | B1 * | 9/2004 | Liu et al. | 200/302.3 |
| 6,897,390 | B2 * | 5/2005 | Caldwell et al. | 200/512 |
| 2006/0049030 | A1 * | 3/2006 | Grems et al. | 200/333 |

* cited by examiner

*Primary Examiner*—Renee S Luebke
*Assistant Examiner*—Lisa Klaus
(74) *Attorney, Agent, or Firm*—Ingrassia Fisher & Lorenz, P.C.

(57) ABSTRACT

Methods and apparatus are provided for an electrical assembly. The apparatus comprises a base member comprising a recessed portion and a circumferential flange, the recessed portion adapted to receive an electrical device and the flange having a channel on a first side and a sealing member comprising a retention portion and a protruding portion disposed on the retention portion, the retention portion adapted to at least partially enclose the circumferential flange with at least part of the sealing member disposed at least partially across the channel, and the protruding portion extending away from the channel.

20 Claims, 3 Drawing Sheets

SEAL FOR ELECTRICAL SWITCH PAD

TECHNICAL FIELD

The subject matter described herein generally relates to sealing devices and methods, and more particularly relates to waterproof elastomeric seals.

BACKGROUND

Switch pads are commonly used with electrical switches to serve as an interface between a user and a device. As one example, a switch pad with an electrical switch can be used to manipulate the position of a window in an automobile. In another implementation, a switch pad with an electrical switch can be used to activate a release mechanism for an automobile component, such as a compartment door, interior, or exterior hatch. Other examples can include such devices as exterior keypads or door activation systems with a remote input device.

In some implementations, the switch pad can be disposed in the external environment, exposing it to the temperature and humidity condition changes normally associated with the ambient atmosphere. Because such external conditions can adversely affect the operation of electrical devices, such as electrical switches, precautions to protect the operation of the devices are routinely employed. One such precaution can include sealing the electrical switch within a weatherproof shell. Such waterproof shells can be intricate or costly to produce.

BRIEF SUMMARY

An apparatus is provided for an electrical assembly. The apparatus comprises a base member comprising a recessed portion and a circumferential flange, the recessed portion adapted to receive an electrical device and the flange having a channel on a first side and a sealing member comprising a retention portion and a protruding portion disposed on the retention portion, the retention portion adapted to at least partially enclose the circumferential flange with at least part of the sealing member disposed at least partially across the channel, and the protruding portion extending away from the channel.

A method is provided for sealing an assembly. The method comprises providing a base member having a first portion, the first portion at least partially surrounded by a flange, the flange extending outwardly from the first portion, said flange having a first side and a recess formed on the first side, the recess extending at least partially around the flange, providing a sealing member, the sealing member comprising an enclosing portion and a protruding portion, the enclosing portion adapted to at least partially surround the flange and the protruding portion adapted to extend at least partially along the enclosing portion and extend away from a surface of the sealing member, and at least partially surrounding the flange with the sealing member such that a portion of the sealing member at least partially overlays the recess and the protruding portion extends away from the recess.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

DESCRIPTION OF THE DRAWINGS

At least one embodiment of a switch assembly will hereinafter be described in conjunction with the following drawing figures, wherein like numerals denote like elements.

DESCRIPTION OF AN EXEMPLARY EMBODIMENT

The following detailed description is merely exemplary in nature and is not intended to limit the embodiment or the application and uses of the apparatus, system, assembly, or methods described. Furthermore, there is no intention to be bound by any expressed or implied theory presented in the preceding technical field, background, brief summary or the following detailed description.

Techniques and technologies may be described herein in terms of functional and/or logical block components and various processing steps. It should be appreciated that such block components may be realized by any number of hardware, software, and/or firmware components configured to perform the specified functions. For example, an embodiment of a system or a component, such as an electrical switch, may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments may be practiced in conjunction with any number of data transmission protocols and that the system described herein is merely one suitable example.

Furthermore, connections between, or dispositions of, objects shown in the various figures contained herein are intended to represent example functional relationships and/or physical couplings between the various elements. Different sizes, shapes, and methods of conjoining or coupling elements and features may be present in different embodiments of the subject matter.

"Connected/Coupled"—The following description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although the figures depict one example arrangement of elements, additional intervening elements, devices, features, or components may be present in an embodiment of the depicted subject matter.

Figure 1:
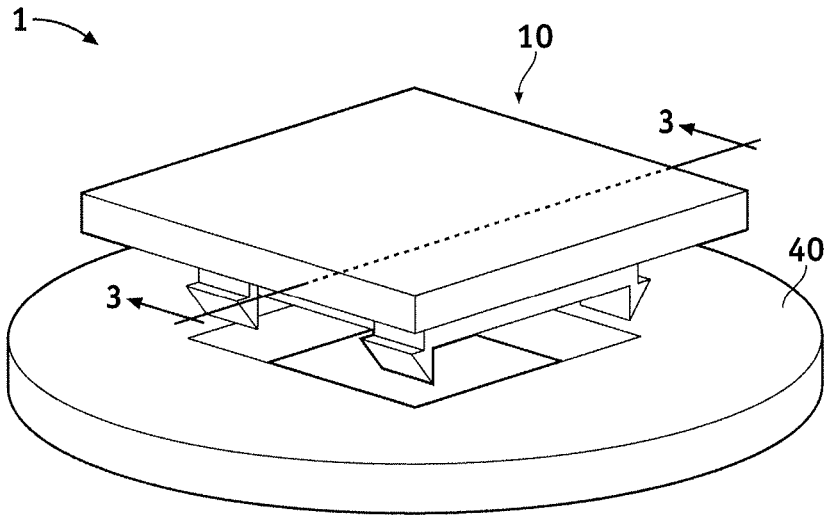
FIG. 1 illustrates a sealed electrical switch pad assembly.

A switch pad can be used to manipulate various electronic and electro-mechanical systems by providing detectable user input. FIG. 1 illustrates a switch assembly 1 comprising a sealed switch pad 10 and a mounting plate 40. The switch assembly 1 can comprise more than one sealed switch pad mounted to or affixed to a single mounting plate 40 or more than one sealed switch pad mounted to or affixed to more than one mounting portion or any combination thereof. As one example, the mounting plate 40 can be formed in a panel, component, or feature of a vehicle, either integrally or as a separate plate or portion. The mounting plate 40 can comprise an opening, receptacle, or reception portion, appropriately sized and shaped to receive the sealed switch pad 10.

Figure 2:
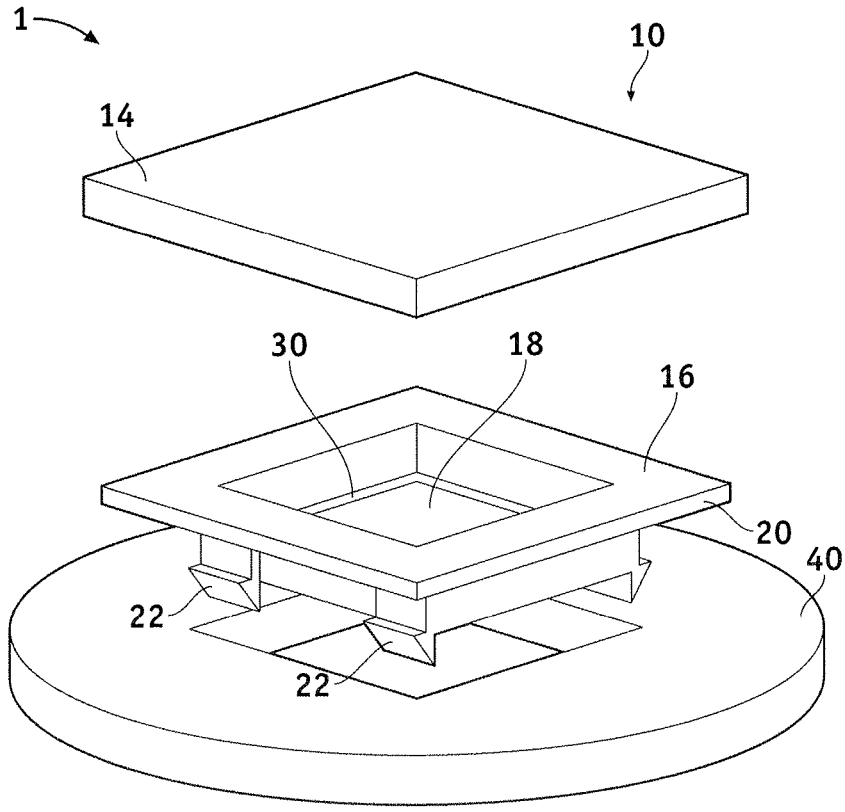
FIG. 2 illustrates an exploded view of the electrical switch pad assembly.

FIG. 2 illustrates an exploded view of the sealed switch pad 10 comprising a seal 14 and a base member 16. The base member 16 can have a quadrilateral shape as shown, or any other desired shape, including without limitation, circular, ovoid, triangular, or any other geometric shape. The base member can be composed of any of several materials, including plastics, metals, ceramics, or any other material suitable to receive an electrical switch and couple with a seal 14. Construction methods used to form the base member 16 can be used as appropriate to the particular material, such as casting, injection-molding, or custom-crafting.

The base member 16 can comprise a recessed portion 30. The recessed portion 30 can be a region of the base member 16 with a height less than the overall height of the base member 16. In some embodiments, such as the illustrated embodiment, the recessed portion 30 can comprise a significant portion of the base member 16. In other embodiments, the recessed portion 30 can be an indentation or notch in a portion of the base member 16, resulting in a localized reduction in height. In the illustrated embodiment, the recessed portion 30 is shown as an indentation in which an electrical switch 18 is disposed. In some embodiments, the recessed portion 30 can have a shape similar to the overall geometric shape of the base member 16, as illustrated in FIG. 2. In some embodiments, the recessed portion 30 can comprise different shapes, preferably permitting the disposition of an electrical component, such as an electrical switch or switching device, or another electronic device. In the illustrated embodiment, the recessed portion 30 is substantially larger than the electrical switch 18. In other embodiments, the recessed portion 30 can conform closely to the size and shape of the electronic device or switch.

Although an electrical switch 18 is described in the illustrated embodiment, other devices can be disposed on or coupled to the base member 16, including without limitation, lighting devices, sensor devices, keypad or touch-key devices, and the like. The base member 16 can couple with or support the electrical switch 18 though any suitable means, including without limitation, an interference fitting, one or more screw mounts, soldering, or an adhesive or glue.

The electrical switch 18 can be manipulated through interaction with the seal 14. In some embodiments, the seal 14 can be composed of an elastomeric material having sufficient elastic properties to deflect inward toward the electrical switch 18 when pressed upon by a finger or other instrument. Preferably, the seal 14 can deflect sufficiently far that the user can contact the electrical switch 18 with the underside of the seal 14. In some embodiments, the electrical switch 18 is a pressure switch, which can be depressed for activation. In some embodiments, the electrical switch 18 can be a flip-type switch, and the seal 14 can be thin enough to permit manipulation of portions of the switch 18.

The base member 16 can have a circumferential flange 20 around the perimeter of the base member 16. The flange 20 can have various sizes and shapes, but preferably is substantially similar to the shape of the base member 16. The flange 20 can extend outward along the perimeter of the base member 16, preferably along the upper edge of the base member 16, but could also be disposed around other locations as well. Preferably the flange 20 has a height less than half the overall height of the base member 16, but the flange 20 can have varying heights in proportion to the overall height of the base member 16.

The base member 16 can have one or more attachment portions or features for securing it to another component. In the illustrated embodiment, a set of prongs 22 are shown, but other methods of attachment can also be used, such as adhesives or screw mounting. The prongs 22 can be formed to produce an interference fit with a mounting portion, such as the mounting plate 40. The mounting plate 40 can have an opening appropriately sized to receive the base member 16, including the recessed portion 30. The mounting plate 40 can be composed of any appropriate material, including, without limitation, plastics, metals, woods, or ceramics. The mounting plate 40 can also be a portion of a larger structure, such as a vehicle, including an automobile or aircraft, or the mounting plate 40 can be a portion of a building. Where the mounting plate 40 is coupled to an automobile, the electrical switch 18 can be used to actuate a release mechanism for a door or hatch. When used on an automobile, a door handle cavity can serve as the mounting plate.

Figure 3:
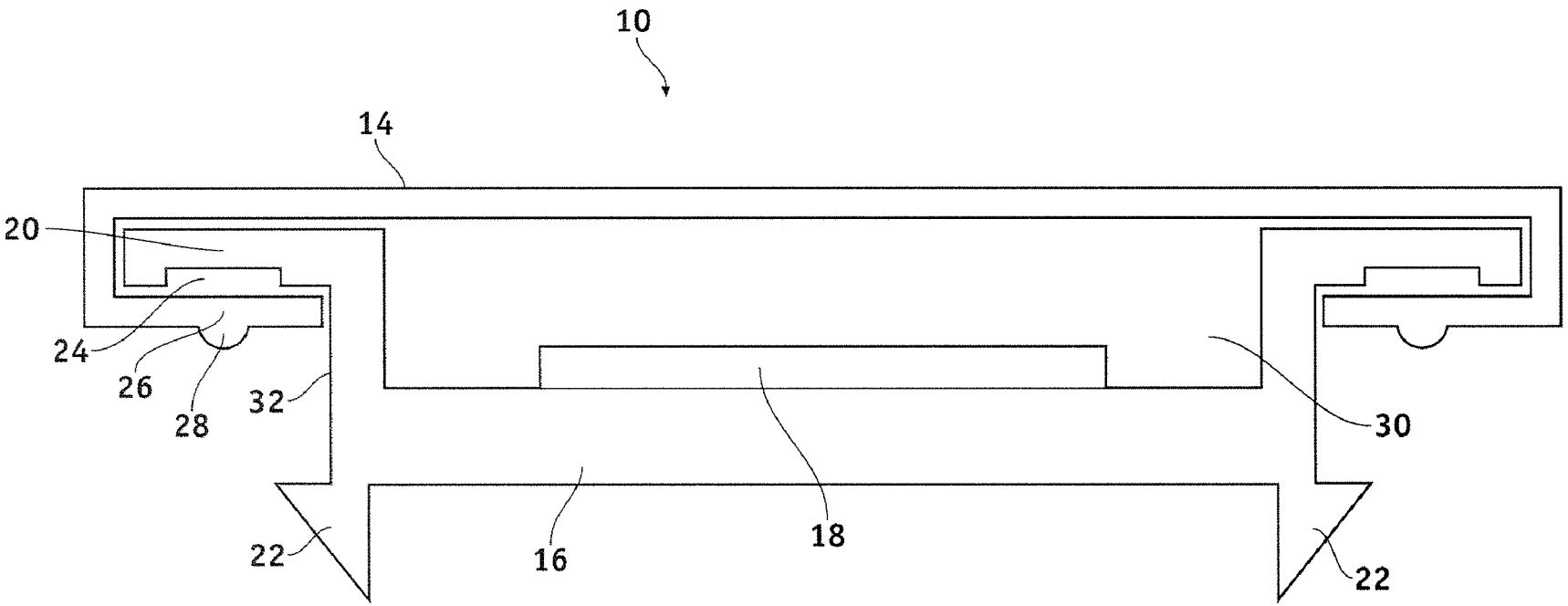
FIG. 3 illustrates a cross-sectional view of the sealed electrical switch pad assembly of FIG. 1.

With reference to FIG. 3, the cross-section of a combined base member 16 and seal 14 is shown. As can be seen, the underside of the flange 20 can have a groove 24. The groove 24 or channel can extend completely around the flange 20, or only part way. Similarly, the groove 24 can present on only some sides of the flange 20, such as only on opposite sides or only on two adjoining sides. The groove 24 is preferably shallow, and thus a small indentation into the flange 20. In some embodiments, however, the groove 24 can have a greater depth and extend substantially into the flange 20.

As can be seen in FIG. 3, the seal 14 can extend across the recessed portion 30 and around the flange 20. In the illustrated embodiment, the seal 14 extends completely across the base member 16, covering the electrical switch 18. In some embodiments, the seal 14 can extend only partially across the base member 16. In certain embodiments, the seal 14 can be formed to accommodate a portion of the base member 16 or another component which passes from the inside of the seal 14 to the outside. In some embodiments, the seal 14 is made from a uniform material, such as an elastomeric material including, without limitation, silicone or silicone rubber, latex, natural rubber, or a plastic. Preferably, the seal 14 is composed of a waterproof material. In other embodiments, the seal 14 can be composed of different materials having varying thickness or degrees of transparency. The seal 14 can also have a membrane which extends across the recessed portion 30. The membrane can be flexible or rigid, and can be integrally formed as a unitary piece or can have an opening.

The seal 14 can have a lip portion 26, or segment, of the seal, which can enclose the flange 20 and extends at least partially towards the outer edge or exterior surface 32 of the base member 16, thereby enveloping at least part of the flange 20. The lip portion 26 can extend across the groove 24, preferably completely across. In some embodiments, the lip portion 26 can extend only partially across, with the seal 14 not in contact with the base member 16 beneath the flange 20. The lip portion 26 can function as a retention member or portion by causing the seal 14 to maintain its position around the flange 20.

The lip portion 26 can have a protruding feature or features, such as a rib 28. In the illustrated embodiment, the rib 28 has a substantially pyramidal or triangular shape, but it can also have other cross-sectional shapes, such as hemispherical, rectangular, pentagonal, or ovoid, or the rib 28 can be irregularly-shaped. Preferably, the rib 28 is disposed on the lip portion 26 disposed across the groove 24. Although the rib 28 is illustrated with its midpoint aligned with the center of the groove 24, other locations are possible as well. Additionally, although the rib 28 is illustrated extending away from the groove 24, the lip portion 26 can also have a rib 28 extending inward toward the groove 24. In some embodiments, the lip portion 26 of the seal 14 can have multiple ribs, with at least one disposed toward the groove 24 or at least one disposed away from the groove 24, with no limit on the number of ribs 28.

Figure 4:
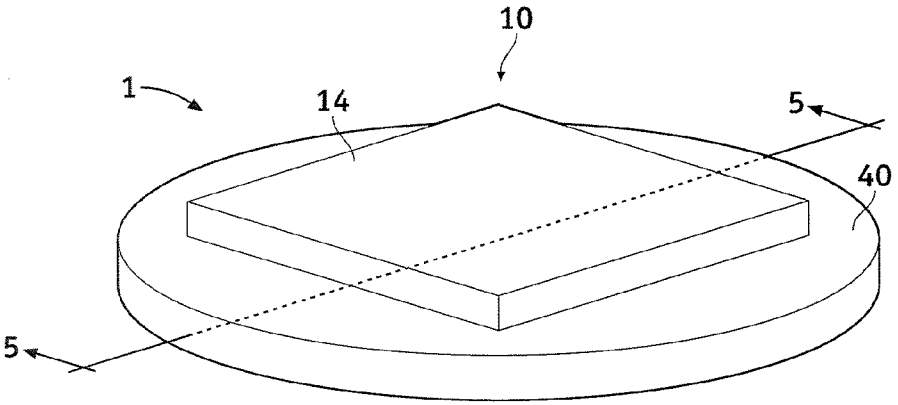
FIG. 4 illustrates a mounted electrical switch pad assembly.
Figure 5:
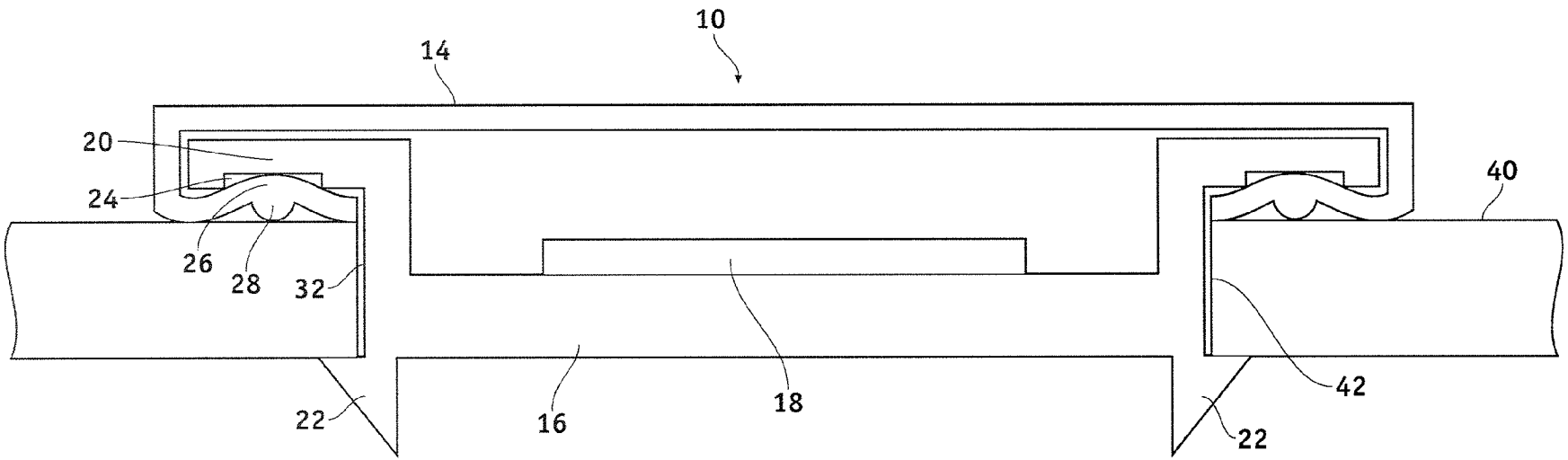
FIG. 5 illustrates a cross-sectional view of the mounted electrical switch pad assembly of FIG. 4.

FIGS. 4 and 5 illustrate a combined seal 14 and base member 16 coupled with a mounting plate 40. As can be seen, the edge 42 of the mounting plate 40 can be disposed against the side of the base member 16. The underside of the lip portion 26 of the seal 14 can also contact the mounting plate 40. Together with the prongs 22, the seal 14 can form an interference fit with the mounting plate 40, thereby securing the base member 16 to the mounting plate 40. As described above, other methods of securing the seal 14 and base member 16 to the mounting plate 40 can also be used.

When the mounting plate 40 contacts the rib 28, upward force is imparted against the rib 28. Preferably, the height of the mounting plate 40 is properly sized to couple with the prong 22 on one side and form an interference fit with the seal 14 on another side. The edge 42 of the mounting plate 40 can be shaped to occupy the entirety of the height between the prong 22 and the seal 14. Accordingly, when contacting the seal 14, the mounting plate 40 will contact the rib 28, deflecting the portion of the seal 14 near the rib 28 towards the groove 24. As can be seen in the illustrated embodiment, the region of the seal 14 near the rib 28 can elastically deform to fill at least part of the groove 24. As a result, the seal 14 is capable of performing more effectively protecting the internal environment of the recessed portion 30 than a seal 14 without a rib 28 and/or a flange without a groove 24. Thus, the thickness of the seal 14, the depth of the groove 24, the height of the edge 42 and the distance between the prongs 22 and the seal 14 are preferably dimensioned and toleranced to cooperate to form a tight interference fit, enhancing the effectiveness of the seal 14.

With the seal 14 disposed between the base member 16 and the mounting plate 40, atmospheric conditions, such as humidity, gaseous particles, or external fluids, such as air or rainwater, are inhibited from entering the recessed portion 30. The deflection of the lip portion 26 towards and at least partially into the groove 24 can further enhance the efficacy of the seal 14 in inhibiting atmospheric intrusion. The seal 14 preferably contacts the upper surface of the groove 24, but can also extend only partially into the groove 24.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described features in any way. Rather, the foregoing detailed description will provide those skilled in the art with a convenient road map for implementing the exemplary embodiment or exemplary embodiments. It should be understood that various changes can be made in the function and arrangement of elements without departing from the scope of the following claims and the legal equivalents thereof.

What is claimed is:

1. A switch assembly comprising:

a rigid base member comprising an outer edge, a recessed portion and a circumferential flange around the outer edge of the base member and away from the recessed portion, the recessed portion adapted to receive an electrical switch and the circumferential flange having a first side and a channel formed on the first side;

an elastomeric sealing member comprising a retention portion and a rib, the retention portion adapted to surround the circumferential flange on at least two sides of the flange, wherein the retention portion extends toward the outer edge of the base member and completely across the channel, and the rib disposed on the retention portion, said rib extending away from the channel; and a mounting plate, the mounting plate comprising a switch assembly reception portion adapted to couple with the base member and deflect at least part of the retention portion and the rib toward the channel.

2. The switch assembly of claim 1, wherein the sealing member is composed of silicone rubber.

3. The switch assembly of claim 1, wherein the base member comprises an injection-molded component.

4. The switch assembly of claim 1, wherein the mounting plate is disposed in a cavity of an automobile handle.

5. The switch assembly of claim 4, wherein the sealing member forms an interference fit with the mounting plate, thereby inhibiting external fluids from passing from the cavity to the electrical switch.

6. The switch assembly of claim 1, wherein:

the channel has a midpoint;

the rib has a midpoint; and the midpoint of the rib is aligned with the midpoint of the channel.

7. An electrical assembly comprising:

a base member comprising a recessed portion and a circumferential flange, the recessed portion adapted to receive an electrical device and the flange having a channel on a first side, the channel having a length; and a sealing member comprising a retention portion and a protruding portion disposed on the retention portion, the retention portion adapted to enclose the circumferential flange with the retention portion disposed across an entirety of the length of the channel, and the protruding portion extending away from the channel.

8. The electrical assembly of claim 7, wherein the sealing member is composed of a waterproof material.

9. The electrical assembly of claim 7, wherein the base member further comprises a retention portion adapted to couple the base member to a receptacle.

10. The electrical assembly of claim 9, wherein the receptacle is disposed against the protruding portion.

11. The electrical assembly of claim 7, wherein the sealing member further comprises a seal portion coupled to the sealing member and adapted to substantially cover the recessed portion at least to the circumferential flange.

12. The electrical assembly of claim 11, wherein the sealing member comprises a membrane that is integrally formed with the sealing member.

13. The electrical assembly of claim 7, wherein:

the channel has a midpoint;

the protruding portion has a midpoint; and the midpoint of the protruding portion is aligned with the midpoint of the channel.

14. The electrical assembly of claim 7, wherein the electrical device comprises an electrical switch.

15. A method of sealing an assembly, including providing a base member having a first portion, the first portion at least partially surrounded by a flange, the flange extending outwardly from the first portion, said flange having a first side and a recess formed on the first side, the recess extending at least partially around the flange;

providing a sealing member, the sealing member comprising an enclosing portion and a protruding portion, the enclosing portion adapted to at least partially surround the flange and extending completely across the recess, and the protruding portion adapted to extend at least partially along the enclosing portion and extend away from a surface of the sealing member; and at least partially surrounding the flange with the sealing member such that a portion of the sealing member at least partially overlays the recess and the protruding portion extends away from the recess.

16. The method of claim 15, wherein the sealing member is adapted to at least partially cover the first portion.

17. The method of claim 15, wherein surrounding the flange with the sealing member comprises enveloping the flange with the enclosing portion of the sealing member.

18. The method of claim 15, further comprising coupling the joined base member and sealing member to a mounting plate to form an interference fit between the mounting plate and the protruding portion.

19. The method of claim 15, wherein:

the recess has a midpoint;

the protruding portion has a midpoint; and the midpoint of the protruding portion is aligned with the midpoint of the recess.

20. The method of claim 15, wherein base member comprises a switching device and the step of at least partially surrounding the flange with the sealing member comprises at least partially covering the switching device with the sealing member.

* * * * *